United States Patent [19]

Child

[11] Patent Number: 4,655,124

[45] Date of Patent: Apr. 7, 1987

[54] CARBONATING APPARATUS

[75] Inventor: Robert P. Child, Portsmouth, England

[73] Assignee: THORN EMI Appliances Limited, London, England

[21] Appl. No.: 752,959

[22] Filed: Jul. 8, 1985

[30] Foreign Application Priority Data

Jul. 12, 1984 [GB] United Kingdom ..... 8417772

[51] Int. Cl.[4] ..... B01F 3/04

[52] U.S. Cl. ..... 99/323.2; 261/65; 261/71; 261/121.1; 261/DIG. 7

[58] Field of Search ..... 99/323.2, 323.1; 141/360; 261/DIG. 7, 121 R, 71, 65

[56] References Cited

U.S. PATENT DOCUMENTS 4,298,551 11/1981 Adolfsson ..... 99/323.1
4,323,090 4/1982 Magi ..... 261/DIG. 7
4,401,607 9/1983 Child ..... 99/323.2
4,481,986 11/1984 Meyers ..... 99/323.2
4,509,569 4/1985 Adolfsson ..... 99/323.1

FOREIGN PATENT DOCUMENTS 1405245 9/1975 United Kingdom .

*Primary Examiner*—Robert W. Jenkins
*Attorney, Agent, or Firm*—Fleit, Jacobson, Cohn & Price

[57] ABSTRACT

Carbonating apparatus includes a reservoir to be filled with fresh water through an outlet. Rotation of a control opens a valve, so that water passes from the reservoir into a pressure vessel. The control is then depressed to cause pressurized gas to be introduced into the water in the vessel, via a nozzle, from a gas cylinder, so as to carbonate the water. A slidably-operable control is then moved by an initial amount to cause a venting valve to open, thereby venting excess gas in the vessel to atmosphere. Further sliding movement of the slidably-operable control depresses a lever connected to an outlet valve, which permits dispensing of the carbonated water from the vessel, via a spout.

7 Claims, 4 Drawing Figures

CARBONATING APPARATUS

This invention relates to carbonating apparatus and in particular, though not exclusively, to such apparatus for carbonating water, which may then be flavoured to produce fizzy beverages.

One known form of carbonating apparatus includes a water reservoir, which is arranged to fill a carbonating vessel with fresh water, and carbonating means for introducing pressurized gas into the water in the vessel. The carbonated water may then be dispensed, via a valve-controlled outlet, from the vessel, either all at once or in smaller amounts when required, and the vessel, when empty, can be refilled with fresh water from the reservoir for subsequent repetition of the carbonation procedure.

However, it is necessary for excess pressure, which accummulates within the carbonating vessel, to be vented therefrom, before the carbonated water is dispensed, so that the water flows out in a controlled manner rather than under an uncontrollably high pressure, which may also cause the dispensed water to lose a substantial amount of its carbonation.

To this end, various control arrangements have been devised, as for example in International Publication No. W082/04243, wherein the dispensing valve is arranged to be automatically opened by a force acting on the valve immediately the pressure in the vessel has fallen beneath a given value, and in U.K. Pat. No. 1,405,245, wherein a single rotatable control must be rotated to a "VENT" position before it can be rotated to a "DISPENSE" position.

A further problem may also arise wherein water vapour is sucked up into a safety exhaust valve, which is employed to prevent the pressure within the vessel from exceeding a predetermined value, and in known exhaust valve systems this generally results in a pool of water forming either on the working surface supporting the apparatus or on a part of the apparatus itself.

It is an object of the present invention to provide carbonating apparatus of the above-mentioned type including an alternative control arrangement to those known hitherto.

It is another object of the invention to alleviate the above-mentioned problem of water spillage from the exhaust valve.

According to the invention there is provided carbonating apparatus including a pressure vessel connected to a reservoir for retaining liquid, means for causing liquid to flow from said reservoir into said vessel to fill said vessel to a predetermined level, means for introducing pressurised gas into the liquid within said vessel to effect carbonation of said liquid, means for venting excess pressure from within said vessel, outlet means for dispensing said carbonated liquid from said vessel, and characterised in that said apparatus also includes a slidably-operable control for activating said venting means upon initial sliding movement of said control and for opening said outlet means to dispense said carbonated liquid upon further sliding of said control.

Preferably, there is also provided a single rotatable control which, when rotated to a first position, is arranged to activate said means for causing liquid to flow from said reservoir into said vessel and, when rotated to a second position, is capable of being depressed to activate said means for introducing pressurised gas into said vessel.

Preferably the carbonating apparatus also includes gas exhaust means for preventing the pressure within the vessel from exceeding a predetermined value, said gas exhaust means being arranged to discharge liquid sucked thereinto into said reservoir.

As a further safety feature, the gas exhaust means may be backed up by a bursting disc arrangement calibrated so as to be susceptible to a higher pressure than that at which the gas exhaust means is arranged to be activated.

The invention will now be further described by way of example only with reference to the accompanying drawings, wherein.

Figure 1:
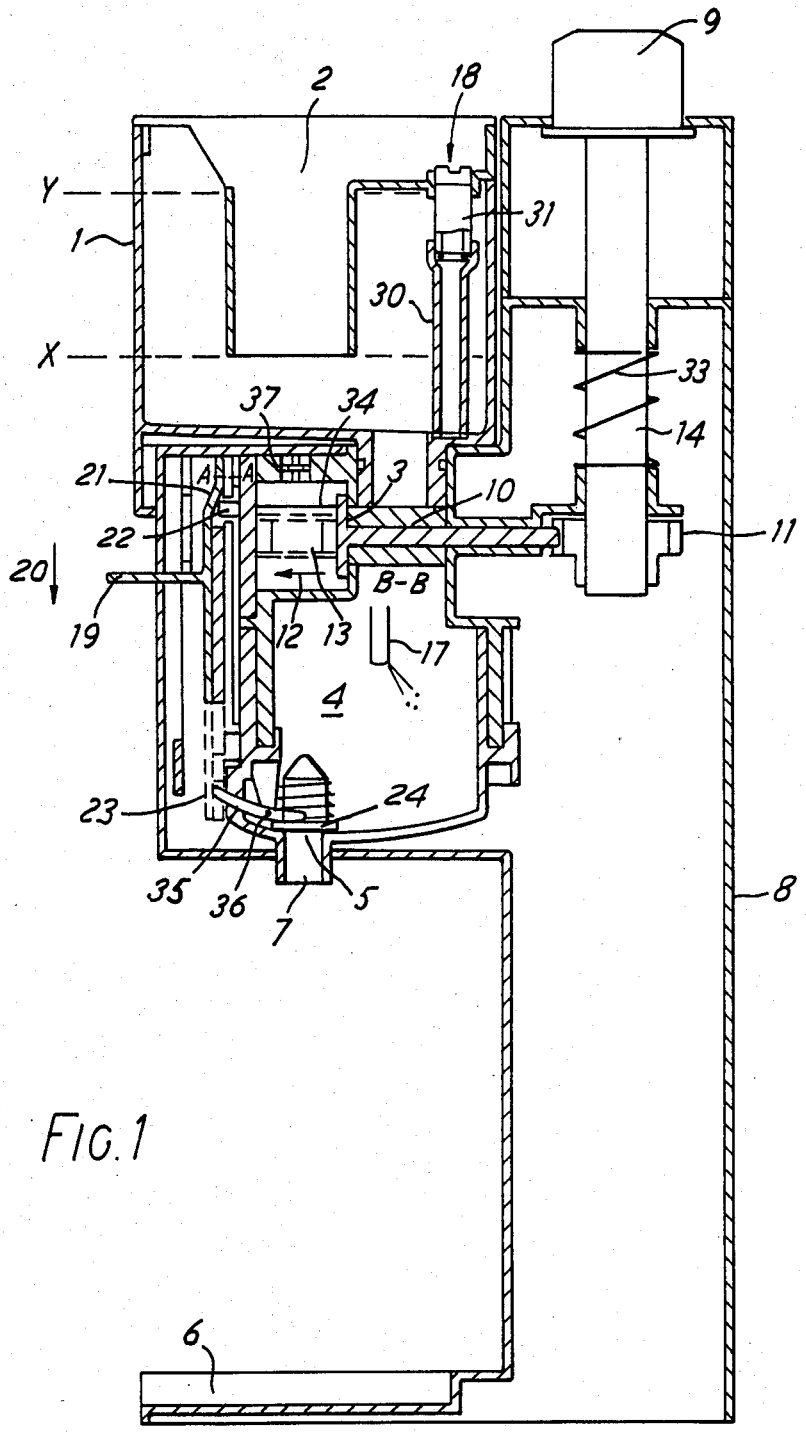
FIG. 1 shows schematically a side sectional view of the carbonating apparatus.

Carbonating apparatus, as shown in FIG. 1, generally consists of a reservoir 1, which is filled with fresh water through inlet 2 and which has an outlet valve 3. The outlet valve 3 leads into a pressure vessel 4, wherein water from the reservoir 1 is carbonated. The pressure vessel 4 has an outlet 5, through which carbonated water passes, via spout 7, into a container, such as a glass (not shown), placed on base 6 of the apparatus. At the rear of the apparatus a housing 8 accommodates a replaceable and a disposable cylinder of pressurised gas (not shown in FIG. 1) for carbonating the water in the vessel 4.

The reservoir 1 is preferably dimensioned so as to accommodate a minimum of 0.25 liters of water up to level X and a maximum of 1 liter of water up to level Y. The pressure vessel 4 is dimensioned to accommodate 0.25 liters of water, so that, in this example, five batches of carbonated water may be made consecutively when the reservoir 1 is filled to the maximum level Y, i.e. four batches can be accommodated in the reservoir 1 and one batch in the pressure vessel 4.

Figure 2:
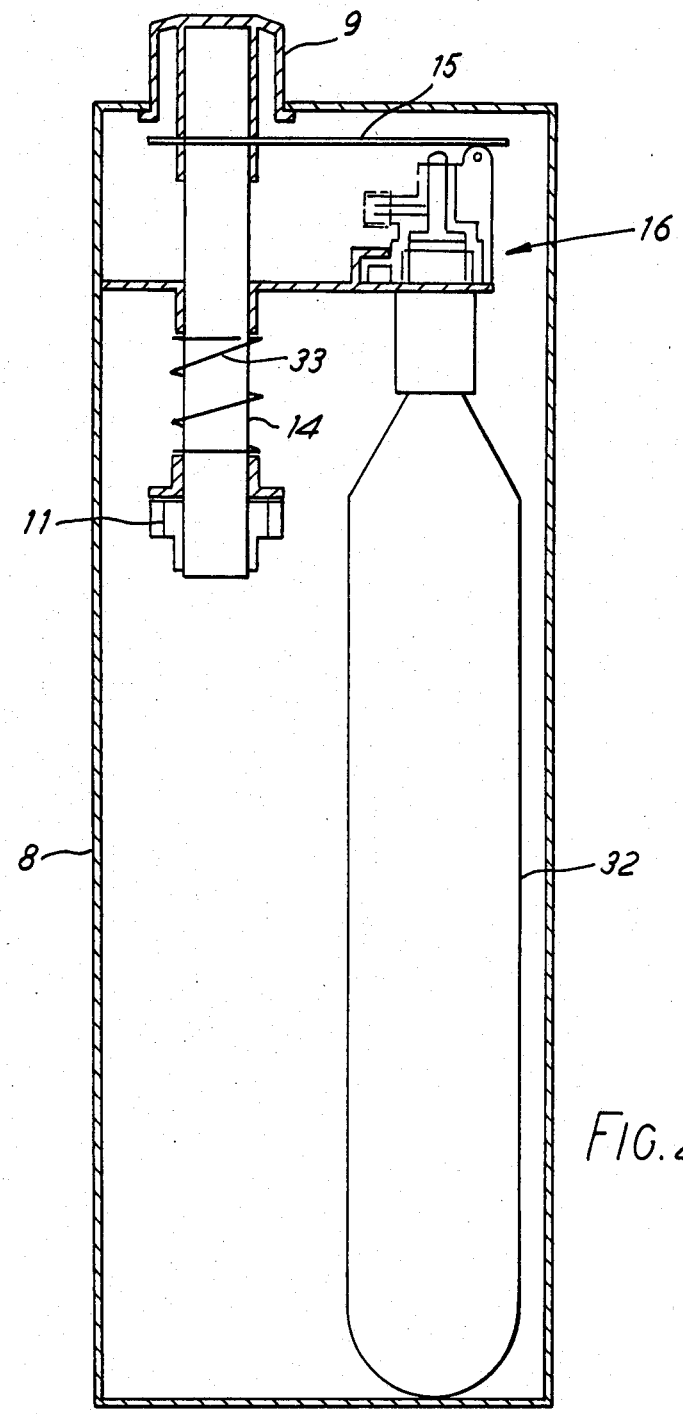
FIG. 2 shows schematically a rear view of the apparatus.

With reference now to FIGS. 1 and 2, fresh water is poured into inlet 2 of the reservoir 1 to a level between minimum level X and maximum level Y, and if particularly cold beverages are required, ice cubes may be added to the water in the reservoir 1. Control knob 9 on top of the housing 8 is then rotated to a "FILL" position, which causes a spring-biassed plunger 10 to ride on a cam 11 and to be thus moved in the direction of arrow 12 against the action of spring 13. Movement of the plunger 10 opens the reservoir outlet valve 3 and permits water to flow, under gravity, from the reservoir 1 into the vessel 4, to a level 34, which is commensurate with, or slightly above, the top of outlet 3, thereby forming an ullage above the level 34 in the vessel 4, in accordance with the air-lock principle. Air bubbles escaping from the vessel 4 up into the reservoir 1 are generally visible during the filling stage, and cessation of the bubbles indicates that filling is complete.

Control knob 9 is then rotated to a "CARBONATE" position which causes plunger 10 to return to its original position and seal the outlet 3 and at which position depression of knob 9 causes compression of a spring 33 on shaft 14 of the knob 9 and also pivotal movement of lever 15, which thus causes a gas valve 16 connected to the gas cylinder 32 to be opened. Pressurised gas is then expelled from cylinder 32, down through a gas nozzle 17 disposed within the pressure vessel 4, and thus into the water contained therein.

An exhaust valve arrangement 18 connects into the ullage above the water level in the vessel 4 and is arranged to prevent the pressure within the vessel from exceeding a predetermined value such as 160 psi, for example, as a safety precaution. The exhaust valve 18 also produces a whistling sound when carbonation of the water within the vessel 4 is complete.

The control knob 9 then automatically returns to a neutral position after the carbonation is complete.

The carbonated water in the vessel 4 may thus be stored under pressure until required or dispensed as soon as the carbonation stage is complete.

The outlet valve 3 from the reservoir 1 into the pressure vessel 4 cannot be opened whilst the vessel 4 is pressurised, due to the pressure acting on the valve 3.

It is necessary before dispensing the carbonated water to reduce substantially the pressure within the vessel, so as to prevent the carbonated water from being dispensed too forcefully and thus uncontrollably.

To this end, a slidably-operable control 19 is slidably depressed for dispensing. Initial downward sliding movement of control 19 in the direction of arrow 20 causes part 21 to depress a plunger 22, which causes a venting valve (shown in FIG. 4) to open, which vents the vessel 4 allowing excess gas therewithin to escape to atmosphere. Operation of the venting valve will be described in more detail hereinafter with respect to FIG. 4.

Further downward sliding movement of control 19 causes part 21 to slide to the position shown by dotted lines at 23, which depresses lever 35, which is pivotted about point 36. The lever 35 is connected to a spring-biassed outlet valve 24, so that depression of lever 35 causes unseating of valve 24 from the outlet 5 of the vessel 4, thereby permitting carbonated water to flow from the vessel 4 into a container (not shown) placed on the base 6, via the spout 7.

The control 19 may then be returned, preferably automatically by a spring action, to its initial position and control knob 9 is automatically rotated to a neutral position before the complete procedure of filling, carbonating, venting and dispensing can be repeated.

The dispensed carbonated water may then be mixed with any desirable flavouring to produce a fizzy beverage. It may be preferable to add the carbonated water to a flavour concentrate, in a glass for example, rather than adding concentrate to a glass of carbonated water, which may then require additional stirring.

Figure 3:
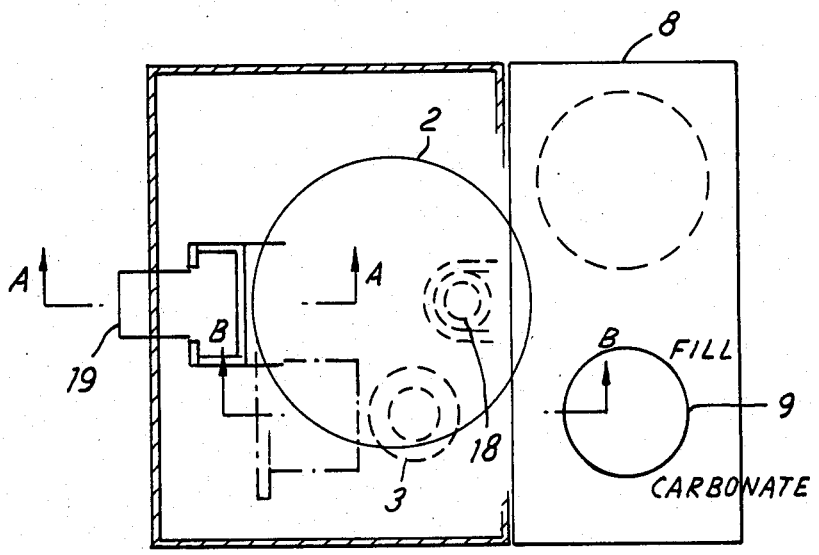
FIG. 3 shows schematically a plan of the apparatus, indicating sections A—A and B—B shown in FIG. 1.

FIG. 3, wherein like parts are labelled with like reference numerals with respect to FIGS. 1 and 2, shows a plan view of the apparatus, indicating the relative positioning of various features thereof.

Figure 4:
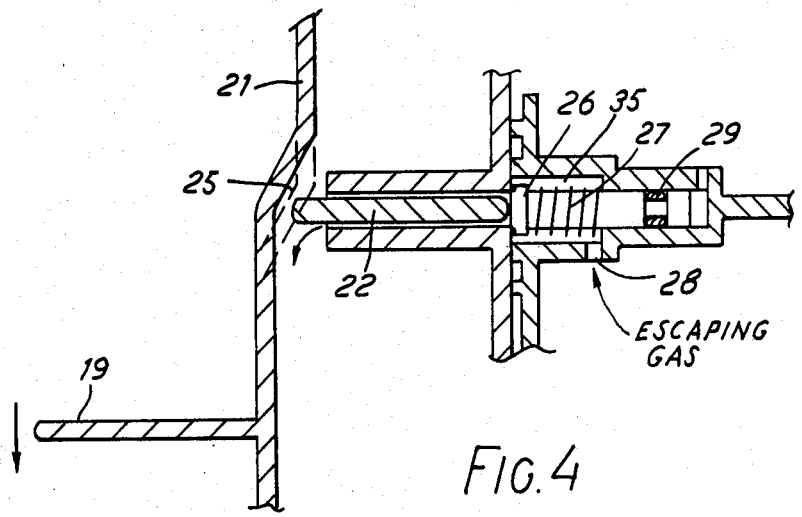
FIG. 4 shows schematically an enlarged sectional view of the venting means of the apparatus shown in FIG. 1.

FIG. 4 shows an enlarged view of the venting valve for causing venting of the vessel 4 before dispensing. Aperture 28 communicates with the vessel 4, so that chamber 35 of the venting valve is filled with gas during the carbonation stage. Upon downward sliding movement of control 19, part 21 moves to dotted line position 25, which depresses the plunger 22. A bonded seal 26 is thus unseated from its closed position and spring 27 is compressed. The gas in chamber 35 is then permitted to escape from the venting valve, via the unseated seal 26 and around the plunger 22, to atmosphere. Further downward movement of control 19 subsequently permits dispensing of the carbonated water to occur. An O-ring 29 may be provided to prevent pressure acting on the rear end of the venting valve.

Furthermore, the slidable control 19 ensures that an acceptable dispense rate of the carbonated water is achieved before, and maintained during, the dispensing stage by maintaining the venting valve in its open condition throughout the dispensing of the carbonated water.

Whilst excess gas is being exhausted from the vessel 4 by the gas exhaust valve arrangement 18, a certain amount of water vapour may be sucked up the arrangement together with the gas, which, due to the location of the exhaust valve in known carbonating apparatus, causes spillage of water on the outside of the apparatus or a surface upon which the apparatus is supported.

However, to alleviate this problem, the present exhaust valve arrangement 18 is arranged to open into the reservoir 1 above the maximum water level Y, so that any water vapour sucked up the arrangement 18 is discharged into the water in the reservoir 1. In order for the valve arrangement 18 to connect the ullage above the water level in the vessel 4 to that above the water level in the reservoir 1, an extension 30 is connected to the known exhaust valve 31.

The exhaust valve arrangement 18 may also be provided, as an additional safety feature, with a bursting disc 37, which is calibrated so as to be suceptible to a higher pressure than that at which the exhaust valve 18 is activated. The bursting disc may be located at any position in communication with the pressure vessel 4. It is preferably located in direct communication with the vessel 4 beneath the reservoir 1, for safety reasons, so that if the disc bursts, it does so internally within a thick part of the casing.

As a further safety feature, control knob 9 is provided with an interlock, which prevents depression of the knob 9 (and thus carbonation) until the knob 9 has been rotated to the "CARBONATE" position.

I claim:

1. Carbonating apparatus including:

a reservoir for retaining liquid;

a pressure vessel connected to said reservoir;

means for causing liquid to flow from said reservoir into said vessel to fill said vessel to a predetermined level;

means for introducing pressurised gas into the liquid within said vessel to effect carbonation of said liquid;

means for venting excess pressure from within said vessel;

outlet means for dispensing said carbonated liquid from said vessel;

a control member;

means for guiding said control member, upon sliding movement thereof, along a rectilinear path;

means to actuate said venting means to vent said excess pressure upon an initial sliding movement of said control member; and means to actuate said outlet means to dispense said carbonated liquid, upon a further sliding movement of said control member.

2. Apparatus as claimed in claim 1 wherein said means to actuate said venting means maintains said actuation upon said further sliding movement of said control member.

3. Apparatus as claimed in claim 1 and including:

a rotary control member;

means to actuate said means for causing said liquid to flow from said reservoir into said vessel, upon rotation of said rotary control member to a first position; and means to actuate said means for intoducing pressurised gas, upon rotation to a second position and subsequent depression of said rotary control member.

4. Apparatus as claimed in claim 1 and including gas exhaust means for releasing pressure from within said vessel whenever said pressure attains a first predetermined level, said gas exhaust means being located relative to said reservoir such that liquid sucked into said gas exhaust means is discharged into said reservoir.

5. Apparatus as claimed in claim 4 and further including a bursting disc assembly for releasing pressure within said vessel, if said pressure attains a second predetermined level higher than said first level.

6. Apparatus as claimed in claim 5 wherein said bursting disc assembly is in direct communication with said pressure vessel and located internally of said apparatus beneath said reservoir.

7. Apparatus as claimed in claim 1 wherein said outlet means comprises a valve, and said means to actuate said outlet means comprises a pivotal lever co-operable with said valve, such that pivotting of said lever, caused by said further sliding movement of said control member, effects opening of said valve.

* * * * *